US011553568B2

(12) United States Patent
Sonst

(10) Patent No.: US 11,553,568 B2
(45) Date of Patent: Jan. 10, 2023

(54) FLICKER MEASUREMENT METHOD AND FLICKER MEASUREMENT SYSTEM

(71) Applicant: Rohde & Schwarz GmbH & Co. KG, Munich (DE)

(72) Inventor: Marcus Sonst, Munich (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 0 days.

(21) Appl. No.: 17/316,284

(22) Filed: May 10, 2021

(65) Prior Publication Data

US 2022/0361302 A1 Nov. 10, 2022

(51) Int. Cl.
*H05B 45/14* (2020.01)
*H05B 45/37* (2020.01)

(52) U.S. Cl.
CPC ..... *H05B 45/14* (2020.01); *H05B 45/37* (2020.01)

(58) Field of Classification Search
CPC ..... G01R 31/44; G01R 35/002; G01R 35/04; G01R 35/06
See application file for complete search history.

(56) References Cited

U.S. PATENT DOCUMENTS

2012/0146516 A1* 6/2012 Kim ..... H05B 33/10 315/134
2018/0348051 A1* 12/2018 Safaee ..... H04N 5/2357

FOREIGN PATENT DOCUMENTS

CN 103954834 A 7/2014
WO WO-2013072802 A1 * 5/2013 ..... G01R 31/40
WO 2019105687 A1 6/2019

* cited by examiner

*Primary Examiner* — Anh Q Tran
(74) *Attorney, Agent, or Firm* — Christensen O'Connor Johnson Kindness PLLC

(57) ABSTRACT

A flicker measurement method is described. The flicker measurement method includes: providing an electrical measurement device, wherein the electrical measurement device includes at least one signal input; providing an LED driver, wherein the LED driver is configured to generate a power signal; electrically connecting the LED driver with the at least one signal input; generating a power signal by the LED driver; and determining a flicker metric based on the power signal by the electrical measurement device. Further, a flicker measurement system is described.

21 Claims, 4 Drawing Sheets

FLICKER MEASUREMENT METHOD AND FLICKER MEASUREMENT SYSTEM

FIELD OF THE DISCLOSURE

Embodiments of the present disclosure generally relate to a flicker measurement method. Embodiments of the present disclosure further relate to flicker measurement system.

BACKGROUND

Light emitting diodes (LEDs) have to be powered with direct current in order to be operated efficiently. Accordingly, an AC-DC converter is necessary in order to operate LEDs with an AC source. Electronic devices that control the current supplied to an LED are generally known as "LED drivers".

In order to ensure that a light generating system comprising an LED and an LED driver provides light in a desired way, usually so-called "flicker measurements" are performed.

During such flicker measurements, the LED is powered by the LED driver. Light generated by the LED is measured via an optical measurement system and converted into a flicker metric, wherein the flicker metric is representative of a quality of the generated light.

However, such flicker measurements only allow for limited conclusions on the performance of the LED driver, as the quality of the light is considerably influenced by ageing effects of the LED and/or spectral line effects of the LED.

Thus, there is a need for a flicker measurement method as well as a flicker measurement system that allow for a more precise evaluation of the performance of an LED driver.

SUMMARY

Embodiments of the present disclosure provide a flicker measurement method. In embodiment, the flicker measurement method comprises the following steps:

providing an electrical measurement device, wherein the electrical measurement device comprises at least one signal input;

providing an LED driver, wherein the LED driver is configured to generate a power signal;

electrically connecting the LED driver with the at least one signal input;

generating a power signal by the LED driver; and determining a flicker metric based on the power signal by the electrical measurement device.

Therein and in the following, the term "power signal" is understood to denote an electrical signal that is configured to power an LED. Accordingly, the power signal may be a DC signal having a predetermined amplitude, wherein the amplitude may vary over time.

The flicker measurement methods disclosed herein are based on the idea to determine the flicker metric directly based on the power signal generated by the LED driver. In other words, the flicker measurement methods disclosed herein allows for determining the flicker metric without converting the power signal into light by an LED. Thus, the determined flicker metric is representative of a performance of the LED driver, without measurement errors introduced by ageing effects of an LED.

Moreover, the flicker measurement method allows to determine the flicker metric without the need for any optical measurement equipment, such as optical filters, photo receivers, etc. Thus, the costs for performing the flicker metric measurements are reduced.

Instead, the necessary measurement equipment for performing the flicker measurements is integrated into a single device, namely the electrical measurement device. This simplifies the cabling needed for setting up the measurement considerably.

According to an aspect of the present disclosure, the LED driver is connected with the at least one signal input via a shunt resistor. The shunt resistor allows for determining an electrical current associated with the power signal. The electrical current input into an LED is proportional to the light intensity of the light generated by the LED. In some embodiments, the light intensity is a known function of the electrical current. Thus, the flicker metric determined with the method according to the present disclosure allows for assessing the light quality of an LED connected to the LED driver without even generating the light in the first place.

According to another aspect of the present disclosure, the power signal is picked up from the LED driver by a probe, wherein the probe is (electrically) connected with the at least one signal input. The probe may be any type of probe that is suitable for picking up the power signal from the LED driver. The power signal may be picked up by the probe by contacting one or several contact points on an electronic circuit of the LED driver, which is generally called "probing".

In an embodiment of the present disclosure, the probe is connected with the at least one signal input via a shunt resistor. The shunt resistor allows for determining an electrical current associated with the power signal. The electrical current applied to an LED is proportional to the light intensity of the light generated by the LED. In some embodiments, the light intensity is a known function of the electrical current. Thus, the flicker metric determined with the method according to the present disclosure allows for assessing the light quality of an LED connected to the LED driver without even generating the light in the first place.

Alternatively, the probe may comprise a shunt resistor. As explained above, this allows for determining an electrical current associated with the power signal by the probe.

According to a further embodiment of the present disclosure, the probe is a voltage probe. Thus, the probe may be configured to measure a voltage associated with the power signal. The voltage may be picked up by the voltage probe by contacting one or several contact points on an electronic circuit of the LED driver.

If the voltage probe comprises a shunt resistor or if the voltage probe is connected to the oscilloscope via a shunt resistor, an electrical current associated with the power signal may be determined based on the measured voltage, for example according to Ohm's law.

In a further embodiment of the present disclosure, the electrical measurement device comprises a low-pass filter that is associated with the at least one signal input, wherein the power signal is filtered by the low-pass filter. Aliasing effects can be suppressed or even removed by the low-pass filter.

A cutoff frequency of the low-pass filter may be chosen in dependence of a sampling frequency of the electrical measurement device. In some embodiments, the cutoff frequency of the low-pass filter may be equal to half the sampling frequency of the electrical measurement device, i.e., to the Nyquist frequency. This way, aliasing effects are avoided.

According to another aspect of the present disclosure, the power signal is digitized with an ADC resolution of at least 12 bit. For example, the power signal may be digitized with an ADC resolution of 16 bit. Thus, the power signal is measured with a high resolution, which allows for capturing the dynamics of the power signal precisely.

The power signal may be transformed into frequency domain, thereby obtaining a transformed power signal, wherein the flicker metric is determined based on the transformed power signal. In some embodiments, a voltage and/or an electrical current associated with the power signal may be measured and transformed into frequency domain. The flicker metric may be determined based on the transformed power signal by a frequency-domain algorithm.

In a further embodiment of the present disclosure, the flicker metric comprises at least one of a stroboscopic visibility measure, a flicker index, a percent flicker, and an MP direct flicker.

In general, the stroboscopic visibility measure assesses strobe effects that can occur in conjunction with moving objects.

In order to determine the stroboscopic visibility measure, normalized frequency components of the power signal may be weighted and summed up. The normalized frequency components may be weighted with different weighting factors, wherein the weighting factors may be configured to simulate human perception.

Alternatively or additionally, the flicker metric may comprise a flicker index. The flicker index corresponds to an area above a line of average light output divided by the total area of the light output curve for a single cycle.

Alternatively or additionally, the flicker metric may comprise a percent flicker. The percent flicker is also known as peak-to-peak contrast, Michelson contrast, modulation (%), or modulation depth.

Alternatively or additionally, the flicker metric may comprise an MP direct flicker. The MP direct flicker is obtained, for example, by the following steps. The power signal is transformed into frequency domain, thereby obtaining a transformed power signal. Component amplitudes of individual frequency components of the transformed power signal are determined. A Weber temporal contrast is determined for each frequency component. The frequency components are weighted according to human perception, thereby obtaining weighted components. The square root of a quadrature sum of the weighted components is determined.

However, it is to be understood that the flicker metric may comprise any metric that is suitable for assessing the performance of the LED driver.

According to another aspect of the present disclosure, the electrical measurement device is an oscilloscope. Alternatively, the electrical measurement device may be any other type of measurement instrument that is suitable for analyzing the power signal and/or for determining the flicker metric.

For example, the electrical measurement device may be a signal analyzer or a vector network analyzer.

Optionally, the electrical measurement device may be connected with an external computer device, wherein the external computer device may be configured to determine the flicker metric and/or to control the measurement device.

For example, the external computer device may be a personal computer, a laptop, a smart phone, a tablet or any other type of smart device.

The external computer device may comprise software or executable instructions that is adapted to determine the flicker metric and/or to control the measurement device.

Moreover, the external computer device may comprise a user interface, wherein a user may control the measurement device by the user interface.

Embodiments of the present disclosure further provide a flicker measurement system. In an embodiment, the flicker measurement system comprises an electrical measurement device and an LED driver. The electrical measurement device comprises at least one signal input. The LED driver is configured to generate a power signal. The LED driver is electrically connected with the at least one signal input. The electrical measurement device is configured to determine a flicker metric based on the power signal.

In some embodiments, the flicker measurement system is configured to perform the flicker measurement method described above.

Regarding the further advantages and properties of the flicker measurement system, reference is made to the explanations given above with respect to the flicker measurement method, which also hold for the flicker measurement system and vice versa.

According to an aspect of the present disclosure, the LED driver is connected with the at least one signal input via a shunt resistor. The shunt resistor allows for determining an electrical current associated with the power signal. The electrical current input into an LED is proportional to the light intensity of the light generated by the LED. In some embodiments, the light intensity is a known function of the electrical current. Thus, the flicker metric determined by the flicker measurement system according to the present disclosure allows for assessing the light quality of an LED connected to the LED driver without even generating the light in the first place.

According to another aspect of the present disclosure, the flicker measurement system comprises a probe that is connected with the at least one signal input, and wherein the probe is configured to pick up the power signal from the LED driver. The probe may be any type of probe that is suitable for picking up the power signal from the LED driver. The power signal may be picked up by the probe by contacting one or several contact points on an electronic circuit of the LED driver.

In an embodiment of the present disclosure, the probe is connected with the at least one signal input via a shunt resistor. The shunt resistor allows for determining an electrical current associated with the power signal. The electrical current applied to an LED is proportional to the light intensity of the light generated by the LED. In some embodiments, the light intensity is a known function of the electrical current. Thus, the flicker metric determined with the flicker measurement system allows for assessing the light quality of an LED connected to the LED driver without even generating the light in the first place.

Alternatively, the probe may comprise a shunt resistor. As explained above, this allows for determining an electrical current associated with the power signal by the probe.

In a further embodiment of the present disclosure, the probe is a voltage probe. Thus, the probe may be configured to measure a voltage associated with the power signal. The voltage may be picked up by the voltage probe by contacting one or several contact points on an electronic circuit of the LED driver.

The electrical measurement device may comprise a low-pass filter that is associated with the at least one signal input, wherein the low-pass filter is configured to filter the power signal. Aliasing effects can be suppressed or even removed by the low-pass filter.

A cutoff frequency of the low-pass filter may be chosen in dependence of a sampling frequency of the electrical measurement device. In some embodiments, the cutoff frequency of the low-pass filter may be equal to half the sampling frequency of the electrical measurement device, i.e., to the Nyquist frequency. This way, aliasing effects are avoided.

According to an aspect of the present disclosure, the electrical measurement device comprises an analog-to-digital converter that is associated with the at least one signal input, wherein the analog-to-digital converter is configured to digitize the power signal. The analog-to-digital converter may be configured to digitize the power signal with an ADC resolution of at least 12 bit, for example with an ADC resolution of 16 bit. Thus, the power signal is measured with a high resolution, which allows for capturing the dynamics of the power signal precisely.

According to another aspect of the present disclosure, the electrical measurement device is configured to transform the power signal into frequency domain, thereby obtaining a transformed power signal, and wherein electrical measurement device is configured to determine the flicker metric based on the transformed power signal. In some embodiments, the electrical measurement device may be configured to measure a voltage and/or an electrical current associated with the power signal, and to transform the measured voltage and/or electrical current into frequency domain. The electrical measurement device may be configured to determine the flicker metric based on the transformed power signal by a frequency-domain algorithm.

In a further embodiment of the present disclosure, the flicker metric comprises at least one of a stroboscopic visibility measure, a flicker index, a percent flicker, or an MP direct flicker.

In general, the stroboscopic visibility measure assesses strobe effects that can occur in conjunction with moving objects.

In order to determine the stroboscopic visibility measure, normalized frequency components of the power signal may be weighted and summed up. The normalized frequency components may be weighted with different weighting factors, wherein the weighting factors may be configured to simulate human perception.

Alternatively or additionally, the flicker metric may comprise a flicker index. The flicker index corresponds to an area above a line of average light output divided by the total area of the light output curve for a single cycle.

Alternatively or additionally, the flicker metric may comprise a percent flicker. The percent flicker is also known as peak-to-peak contrast, Michelson contrast, modulation (%), or modulation depth.

Alternatively or additionally, the flicker metric may comprise an MP direct flicker. The MP direct flicker can be obtained, for example, by the following steps. The power signal is transformed into frequency domain, thereby obtaining a transformed power signal. Component amplitudes of individual frequency components of the transformed power signal are determined. A Weber temporal contrast is determined for each frequency component. The frequency components are weighted according to human perception, thereby obtaining weighted components. The square root of a quadrature sum of the weighted components is determined.

However, it is to be understood that the flicker metric may comprise any metric that is suitable for assessing the performance of the LED driver.

The electrical measurement device is may be an oscilloscope. Alternatively, the electrical measurement device may be any other type of measurement instrument that is suitable for analyzing the power signal and/or for determining the flicker metric.

For example, the electrical measurement device may be a signal analyzer or a vector network analyzer.

Optionally, the electrical measurement device may be connected with an external computer device, wherein the external computer device may be configured to determine the flicker metric and/or to control the measurement device.

For example, the external computer device may be a personal computer, a laptop, a smart phone, a tablet or any other type of smart device.

The external computer device may comprise software that is adapted to determine the flicker metric and/or to control the measurement device.

Moreover, the external computer device may comprise a user interface, wherein a user may control the measurement device by the user interface.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed. Similarly, any steps described herein may be interchangeable with other steps, or combinations of steps, in order to achieve the same or substantially similar result. Moreover, some of the method steps can be carried serially or in parallel, or in any order unless specifically expressed or understood in the context of other method steps.

In the foregoing description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure.

Further, it will be appreciated that embodiments of the present disclosure may employ any combination of features described herein.

Figure 1:
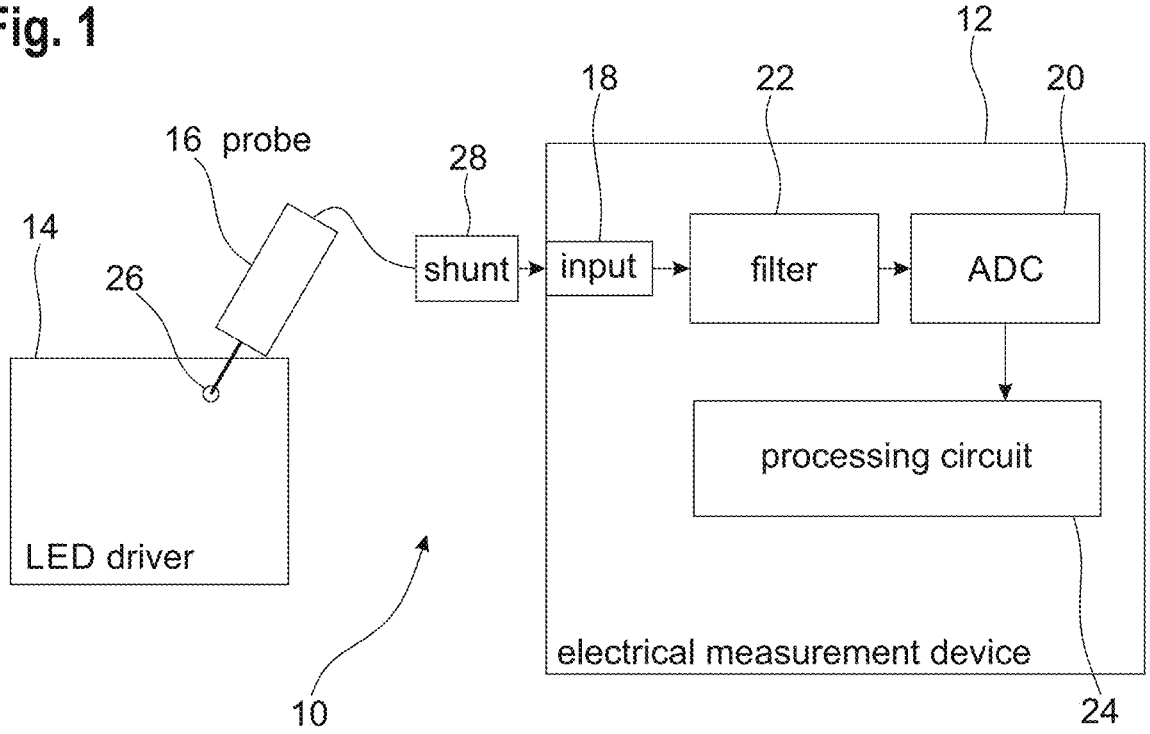
FIG. 1 schematically shows a flicker measurement system according to a first embodiment of the present disclosure.

FIG. 1 schematically shows an example of a flicker measurement system 10. The flicker measurement system 10 comprises an electrical measurement device 12, an LED driver 14, and a probe 16. In the embodiment shown, the electrical measurement device 12 comprises a signal input 18, at least one analog-to-digital converter (ADC) 20, a low-pass filter 22, and a signal processing circuit 24.

The LED driver 14 is configured to generate a power signal that is configured to power an LED. In general, the power signal is an electrical DC signal, wherein an amplitude of the DC signal may vary over time. In some embodiments, the LED driver 14 may be configured to control the amplitude of the power signal in a predefined way, such that the quality of the light output by an LED attached to the LED driver 14 is optimized. In some embodiments, the electrical measurement device 12 may be established as an oscilloscope. Alternatively, the electrical measurement device 12 may be any other type of measurement instrument that is suitable for performing measurements of electrical signals. For example, the electrical measurement device 12 may be a signal analyzer or a vector network analyzer.

The probe 16 is configured to pick up the power signal generated by the LED driver 14. For example, the probe 16 may contact at least one predefined contact point 26 of the LED driver in order to pick up the power signal. The probe 16 may be established as a voltage probe. Accordingly, the probe 16 may be configured to pick up a voltage associated with the power signal.

The probe 16 is connected with the electrical measurement device 12, In some embodiments, the probe 16 is connected with the signal input 18 via a shunt resistor 28. The shunt resistor 28 has a known electrical resistance. Thus, the shunt resistor 28 allows for determining an electrical current associated with the power signal based on the measured voltage associated with the power signal based on Ohm's law.

Figure 2:
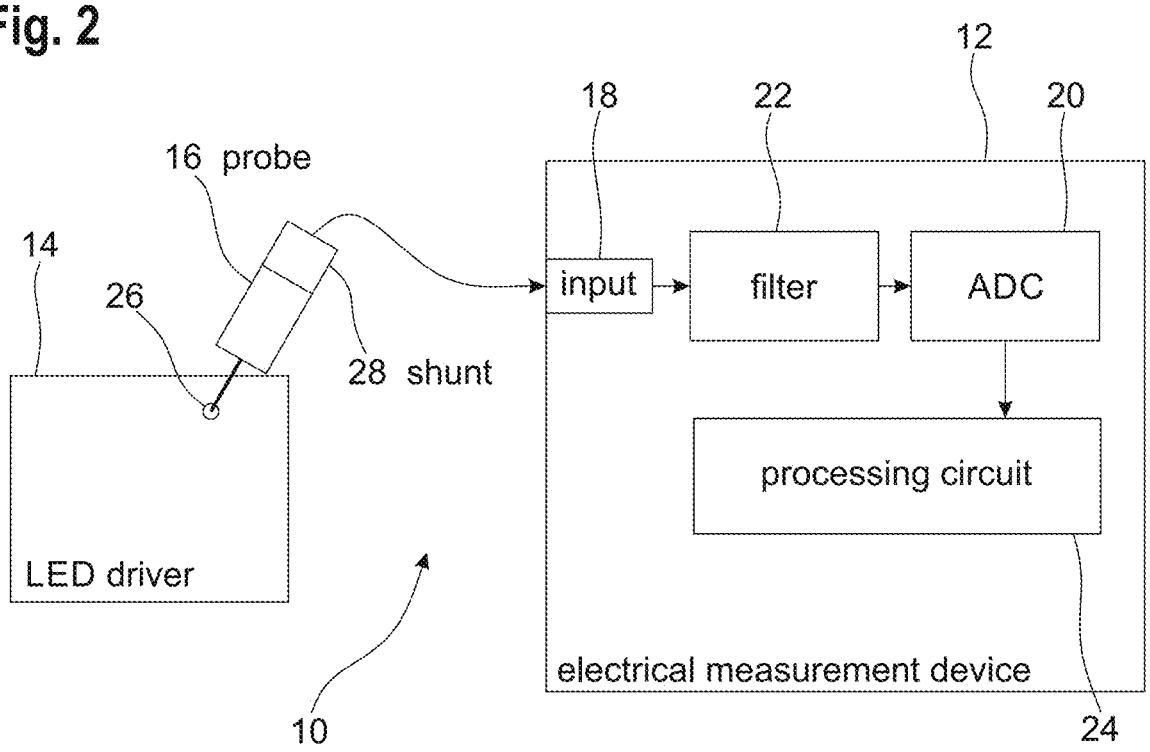
FIG. 2 schematically shows a flicker measurement system according to a second embodiment of the present disclosure.

FIG. 2 shows another embodiment of the flicker measurement system 10, wherein only the differences compared to the first embodiment described above will be explained hereinafter for clarity and brevity.

In the second embodiment, the probe 16 comprises the shunt resistor 28. Accordingly, the probe 16 may be configured to pick up a voltage associated with the power signal and an electrical current associated with the power signal.

Figure 3:
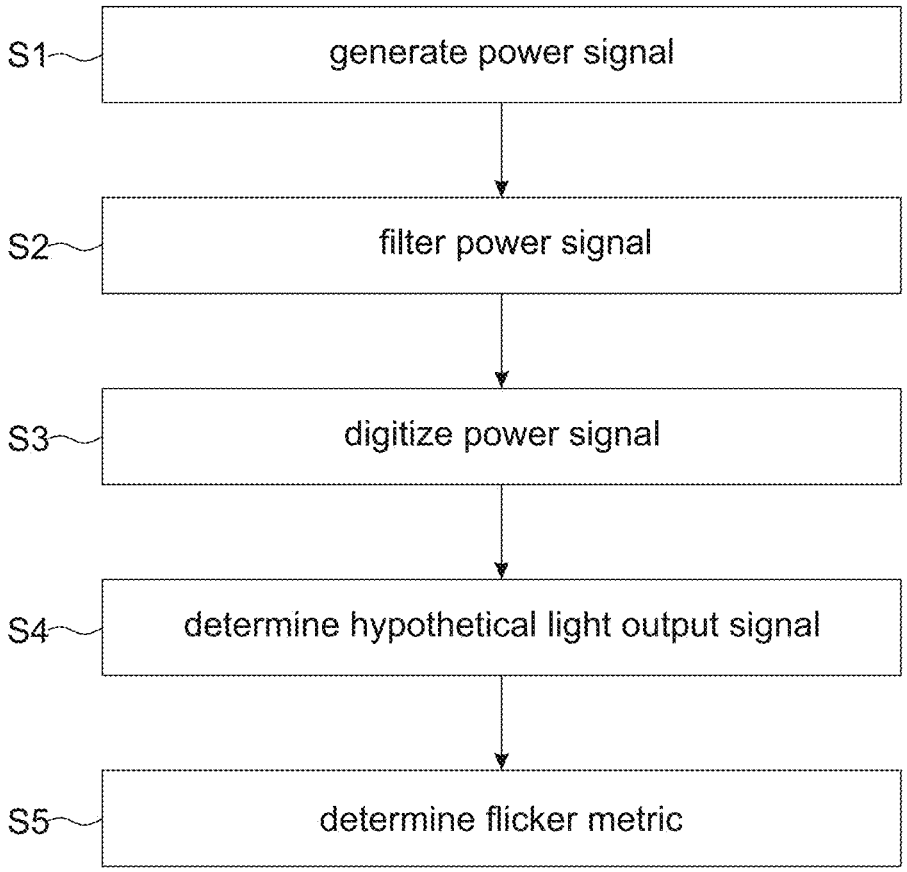
FIG. 3 shows a flow chart of a flicker measurement method according to an embodiment of the present disclosure.

The embodiments of the flicker measurement system 10 are configured to perform a flicker measurement method that is described, for example, in the following with reference to FIG. 3.

A power signal is generated by the LED driver 14 and is picked up by the probe 16 (step S1). In some embodiments, a voltage signal associated with the power signal is picked up by the probe 16. Additionally, an electrical current signal may be generated by the shunt resistor 28 based on the voltage signal picked up by the probe 16. Thus, the power signal may comprise the voltage signal and/or the electrical current signal. The power signal, for example the voltage signal and/or the electrical current signal, is forwarded to the signal input 18.

The power signal is filtered by the low-pass filter 22 (step S2). In other words, signal components of the power signal having a frequency that is bigger than a certain cutoff frequency of the low-pass filter 22 are filtered out by the low-pass filter 22.

The cutoff frequency of the low-pass filter 22 may be chosen in dependence of a sampling frequency of the electrical measurement device 12, i.e., a sampling frequency of the at least one ADC 20. In some embodiments, the cutoff frequency of the low-pass filter 22 may be equal to half the sampling frequency of the least one ADC 20, i.e., to the Nyquist frequency. This way, aliasing effects are avoided.

The power signal is digitized by the ADC 20, thereby obtaining a digitized power signal (step S3). The power signal is digitized with an ADC resolution of at least 12 bit. For example, the power signal may be digitized with an ADC resolution of 16 bit. Thus, the power signal is measured with a high resolution, which allows for capturing the dynamics of the power signal precisely.

The digitized power signal is forwarded to the signal processing circuit 24. Optionally, a hypothetic light output signal is determined by the signal processing circuit (step S4).

The term "hypothetic" denotes that no LED has to be attached to the LED driver 14. The hypothetic light output signal is the light output that an LED attached to the LED driver 14 would generate, if the LED was powered by the respective power signal.

Figure 4:
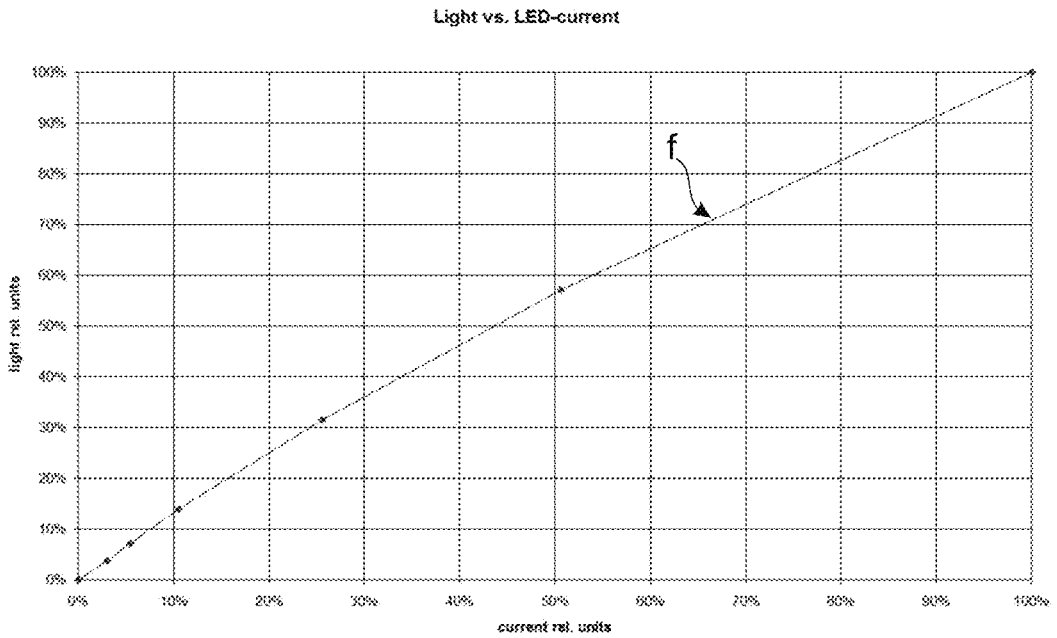
FIG. 4 shows a diagram of a light output of an LED plotted against input current.

As is illustrated in FIG. 4, the light output of an LED is a function (f) of the magnitude of the electrical current supplied to the LED. The function (f) may be known from a datasheet of the corresponding LED. Alternatively, the function (f) may be approximated to be linear. Accordingly, the hypothetic light output signal may be determined based on the function (f) and based on the digitized power signal.

A flicker metric is determined by the signal processing circuit 24 based on, for example, the digitized power signal and/or based on the hypothetic light output signal (step S5). Due to the known relation between the digitized power signal and the hypothetic light output signal, either one of these two signals can be used for determining the flicker metric. Accordingly, if the term "hypothetical light output signal" is used hereinafter, it could also be replaced by "digitized power signal", and vice versa.

In general, the flicker metric may comprise any metric that is suitable for assessing the performance of the LED driver 14. Four different examples for the flicker metric are described in the following with reference to FIGS. 5 and 6. The flicker metric may comprise a flicker index and/or a percent flicker.

Figure 5:
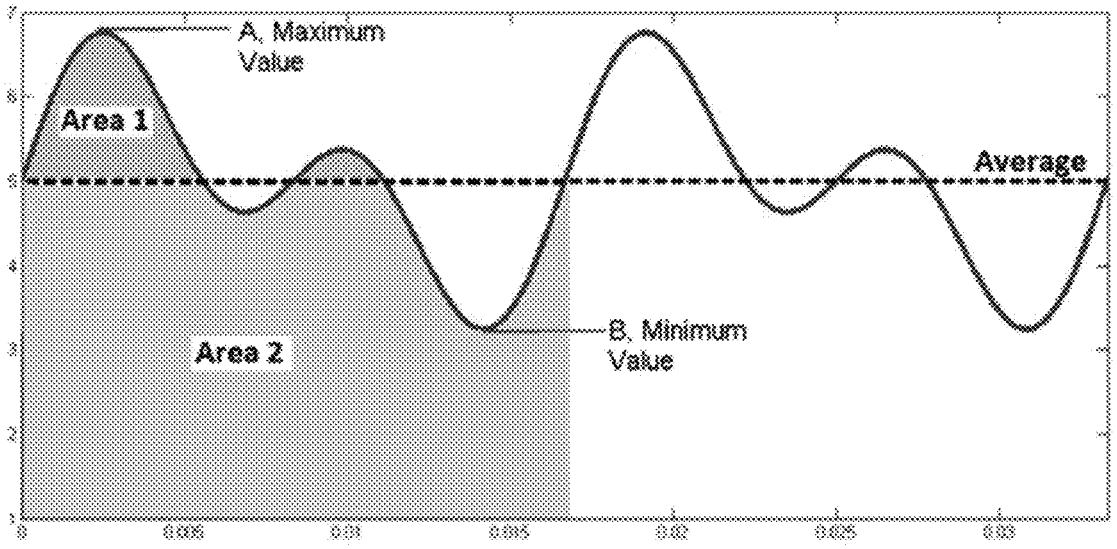
FIG. 5 shows a diagram of a hypothetical light output signal plotted against time.

FIG. 5 shows the hypothetic light output signal plotted against time. The hypothetic light output signal varies around its average value, which is denoted by "Average" in FIG. 5.

The flicker index is defined as the area above the average output ("Area 1" in FIG. 5) divided by the total area of the light output curve for a single cycle ("Area 1+Area 2" in FIG. 5).

Thus, the flicker index is given by the equation $$\text{Flicker Index}=(\text{Area 1})/(\text{Area 1}+\text{Area 2}).$$

The percent flicker, also known as peak-to-peak contrast, Michelson contrast, modulation (%), or modulation depth, is defined by a maximum value A of the hypothetic light output signal and a minimum value B of the hypothetic light output signal as follows:

$$\text{Percent Flicker}=\text{Mod }\%=100(A-B)/(A+B)$$

The flicker index and the percent flicker are metrics that can be determined in time domain.

However, there are metrics that are determined in frequency domain. Accordingly, the digitized power signal and/or the hypothetic light output signal are transformed into frequency domain, for example by a fast Fourier transform, for determining the flicker metrics described hereinafter.

Figure 6:
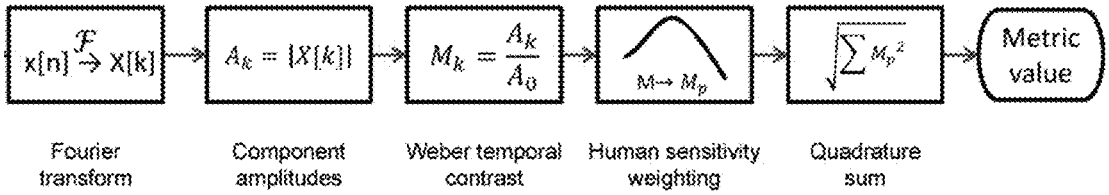
FIG. 6 schematically shows a representative flow chart of steps performed for determining an MP direct flicker.

The flicker metric may comprise an MP direct flicker. Example steps performed for determining the MP direct flicker are illustrated in FIG. 6.

The power signal x[n] is transformed into frequency domain, thereby obtaining a transformed power signal X[k].

Component amplitudes $A_k=|X[k]|$ of individual frequency components of the transformed power signal X[k] are determined.

A Weber temporal contrast $M_k=A_k/A_0$ is determined for each frequency component.

The frequency components are weighted according to human perception, thereby obtaining weighted components $M_p$. In other words, the individual frequency components are each scaled by a predetermined weighting factor that simulates the human perception of the corresponding frequency.

The square root of a quadrature sum of the weighted components is determined. Thus, the MP direct flicker is given by $$MP \text{ direct flicker}=\sqrt{\Sigma M_p^2}.$$

Alternatively or additionally, the flicker metric may comprise a stroboscopic visibility measure (SVM).

In general, the stroboscopic visibility measure assesses strobe effects that can occur in conjunction with moving objects. In order to determine the stroboscopic visibility measure, normalized frequency components $C_i$ of the power signal are determined, weighted, and summed up.

The normalized frequency components $C_i$ are weighted with different weighting factors $T_i$, wherein the weighting factors are configured to simulate human perception.

Accordingly, the SVM is given by $$SVM = \sqrt[3,7]{\sum_{i=1}^{N(\leq 2kHz)} \left(\frac{Ci}{Ti}\right)^{3,7}}$$

The flicker measurement method described above allows for determining the flicker metric without converting the power signal into light by an LED. Thus, the determined flicker metric is representative of a performance of the LED driver 14, without measurement errors introduced by ageing effects of an LED.

Moreover, the flicker measurement method described above allows to determine the flicker metric without the need for any optical measurement equipment, such as optical filters, photo receivers, etc. Thus, the costs for performing the flicker metric measurements are reduced.

Instead, the necessary measurement equipment for performing the flicker measurements is integrated into a single device, namely the electrical measurement device 12. This simplifies the cabling needed for setting up the flicker measurements considerably.

Certain embodiments disclosed herein include, for example, components that utilize circuitry (e.g., one or more circuits) in order to implement standards, protocols, methodologies or technologies disclosed herein, operably couple two or more components, generate information, process information, analyze information, generate signals, encode/decode signals, convert signals, transmit and/or receive signals, control other devices, etc. Circuitry of any type can be used. It will be appreciated that the term "information" can be use synonymously with the term "signals" in this paragraph. It will be further appreciated that the terms "circuitry," "circuit," "one or more circuits," etc., can be used synonymously herein.

In an embodiment, circuitry includes, among other things, one or more computing devices such as a processor (e.g., a microprocessor), a central processing unit (CPU), a digital signal processor (DSP), an application-specific integrated circuit (ASIC), a field-programmable gate array (FPGA), a system on a chip (SoC), or the like, or any combinations thereof, and can include discrete digital or analog circuit elements or electronics, or combinations thereof. In an embodiment, circuitry includes hardware circuit implementations (e.g., implementations in analog circuitry, implementations in digital circuitry, and the like, and combinations thereof).

In an embodiment, circuitry includes combinations of circuits and computer program products having software or firmware instructions stored on one or more computer readable memories that work together to cause a device to perform one or more protocols, methodologies or technologies described herein. In an embodiment, circuitry includes circuits, such as, for example, microprocessors or portions of microprocessor, that require software, firmware, and the like for operation. In an embodiment, circuitry includes one or more processors or portions thereof and accompanying software, firmware, hardware, and the like.

The present application may reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The terms "about," "approximately," "near," etc., mean plus or minus 5% of the stated value. For the purposes of the present disclosure, the phrase "at least one of A and B" is equivalent to "A and/or B" or vice versa, namely "A" alone, "B" alone or "A and B.". Similarly, the phrase "at least one of A, B, and C," for example, means (A), (B), (C), (A and B), (A and C), (B and C), or (A, B, and C), including all further possible permutations when greater than three elements are listed.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The embodiments of the invention in which an exclusive property or privilege is claimed are defined as follows:

1. A flicker measurement method, the flicker measurement method comprising:

providing an electrical measurement device, wherein the electrical measurement device comprises at least one signal input;

providing an LED driver, wherein the LED driver is configured to generate a power signal;

electrically connecting the LED driver with the at least one signal input;

generating a power signal by the LED driver; and determining a flicker metric based on the power signal by the electrical measurement device, wherein the flicker metric is determined directly based on the power signal generated by the LED driver.

2. The flicker measurement method of claim 1, wherein the LED driver is connected with the at least one signal input via a shunt resistor.

3. The flicker measurement method of claim 1, wherein the power signal is picked up from the LED driver by a probe, and wherein the probe is connected with the at least one signal input.

4. The flicker measurement method of claim 3, wherein the probe is connected with the at least one signal input via a shunt resistor.

5. The flicker measurement method of claim 4, wherein the probe is a voltage probe.

6. The flicker measurement method of claim 1, wherein the electrical measurement device comprises a low-pass filter that is associated with the at least one signal input, and wherein the power signal is filtered by the low-pass filter.

7. The flicker measurement method of claim 1, wherein the power signal is digitized with an ADC resolution of at least 12 bit.

8. The flicker measurement method of claim 1, wherein the power signal is transformed into frequency domain, thereby obtaining a transformed power signal, and wherein the flicker metric is determined based on the transformed power signal.

9. The flicker measurement method of claim 1, wherein the flicker metric comprises at least one of a stroboscopic visibility measure, a flicker index, a percent flicker, or an MP direct flicker.

10. The flicker measurement method of claim 1, wherein the electrical measurement device is an oscilloscope.

11. A flicker measurement system, comprising:

an electrical measurement device and an LED driver, wherein the electrical measurement device comprises at least one signal input, wherein the LED driver is configured to generate a power signal, wherein the LED driver is electrically connected with the at least one signal input, and wherein the electrical measurement device is configured to determine a flicker metric based on the power signal, wherein the flicker metric is determined directly based on the power signal generated by the LED driver.

12. The flicker measurement system of claim 11, wherein the LED driver is connected with the at least one signal input via a shunt resistor.

13. The flicker measurement system of claim 11, wherein the flicker measurement system comprises a probe that is connected with the at least one signal input, and wherein the probe is configured to pick up the power signal from the LED driver.

14. The flicker measurement system of claim 13, wherein the probe is connected with the at least one signal input via a shunt resistor.

15. The flicker measurement system of claim 13, wherein the probe is a voltage probe.

16. The flicker measurement system of claim 11, wherein the electrical measurement device comprises a low-pass filter that is associated with the at least one signal input, and wherein the low-pass filter is configured to filter the power signal.

17. The flicker measurement system of claim 11, wherein the electrical measurement device comprises an analog-to-digital converter that is associated with the at least one signal input, and wherein the analog-to-digital converter is configured to digitize the power signal.

18. The flicker measurement system of claim 11, wherein the electrical measurement device is configured to transform the power signal into frequency domain, thereby obtaining a transformed power signal, and wherein electrical measurement device is configured to determine the flicker metric based on the transformed power signal.

19. The flicker measurement system of claim 11, wherein the flicker metric comprises at least one of a stroboscopic visibility measure, a flicker index, a percent flicker, or an MP direct flicker.

20. The flicker measurement system of claim 11, wherein the electrical measurement device is an oscilloscope.

21. A flicker measurement system, comprising:

an electrical measurement device comprises at least one signal input; and an LED driver configured to generate a power signal, wherein the LED driver is electrically connected with the at least one signal input of the electrical measurement device, wherein the electrical measurement device is configured to determine a flicker metric based on the power signal, and wherein the flicker metric is determined without converting the power signal into light.

* * * * *